US009124052B2

(12) United States Patent
Elwart

(10) Patent No.: US 9,124,052 B2
(45) Date of Patent: Sep. 1, 2015

(54) SELF GROUNDING ELECTRICAL OUTLET

(71) Applicant: John Ernest Elwart, Playa Del Rey, CA (US)

(72) Inventor: John Ernest Elwart, Playa Del Rey, CA (US)

( * ) Notice: Subject to any disclaimer, the term of this patent is extended or adjusted under 35 U.S.C. 154(b) by 112 days.

(21) Appl. No.: 14/033,458

(22) Filed: Sep. 21, 2013

(65) Prior Publication Data

US 2015/0087169 A1 Mar. 26, 2015

(51) Int. Cl.

| | |
|---|---|
| ***H01R 24/78*** | (2011.01) |
| ***H01R 25/00*** | (2006.01) |
| ***H01R 29/00*** | (2006.01) |

(52) U.S. Cl.

CPC ..... *H01R 24/78* (2013.01); *H01R 25/006* (2013.01); *H01R 29/00* (2013.01)

(58) Field of Classification Search

CPC ..... H01R 25/006; H01R 13/648; H01R 13/7135; H01R 29/00; H01R 24/78

USPC ..... 439/108

See application file for complete search history.

(56) References Cited

U.S. PATENT DOCUMENTS

| | | | | |
|---|---|---|---|---|
| 3,775,727 | A * | 11/1973 | Wise | 439/105 |
| 8,159,803 | B2 * | 4/2012 | Ward et al. | 361/103 |
| 8,587,148 | B2 * | 11/2013 | Garb et al. | 307/39 |
| 2013/0220661 | A1 * | 8/2013 | Tetreault et al. | 174/51 |

* cited by examiner

*Primary Examiner* — Michael Zarroli

(57) ABSTRACT

This disclosure is directed to an electrical outlet whereby the neutral terminal and the ground terminal are mechanically and electrically connected. This device utilizes a common 3 prong outlet retrofitted to the present invention specifications.

1 Claim, 1 Drawing Sheet

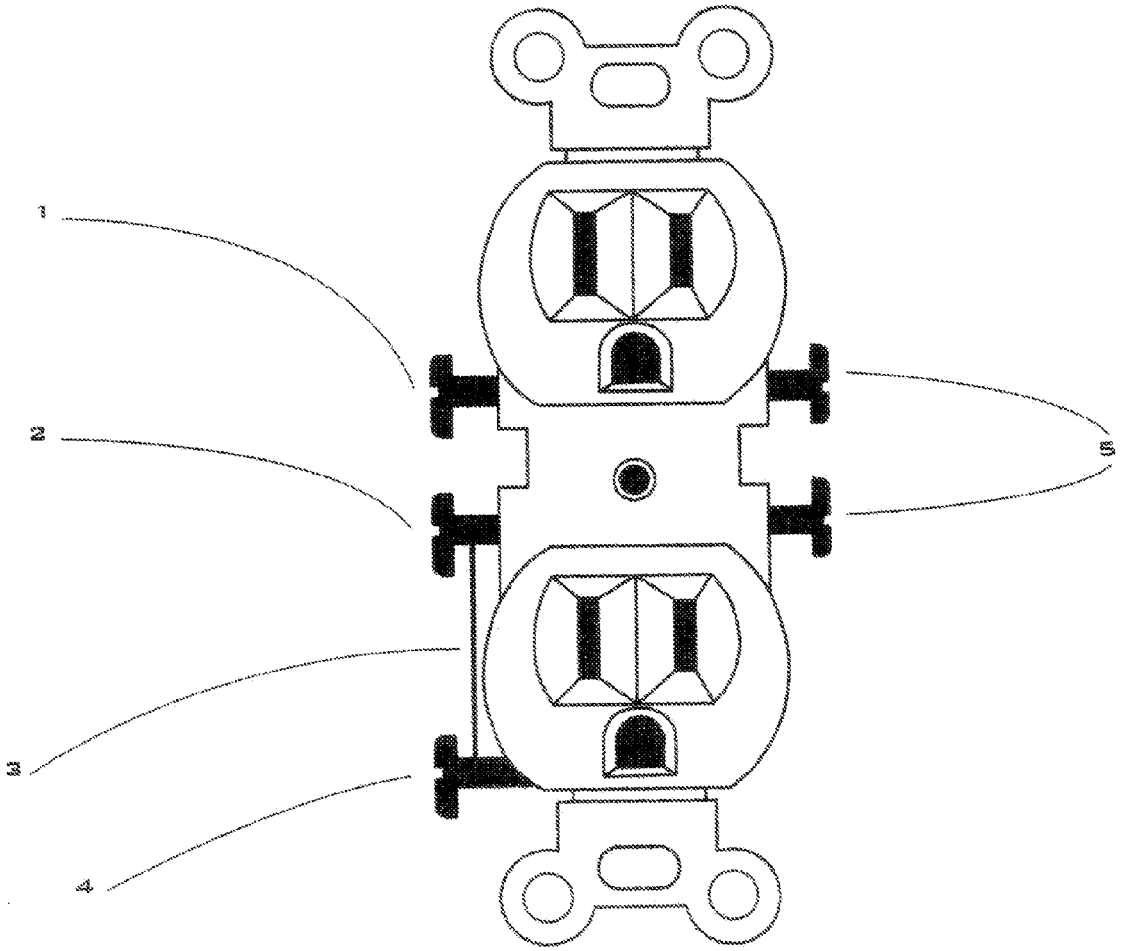
1
2
3
4
5

SELF GROUNDING ELECTRICAL OUTLET

FIELD OF THE INVENTION

The present invention relates to a common three prong electrical outlet supplying 120 volts to any product that uses 120 volts. In particular, the present invention is a modification of the common 120 volt outlet in that the neutral bar is mechanically electrically connected to the ground screw on the outlet. This is accomplished by connecting a wire to the neutral terminal on the outlet and connecting the other end of same wire to the ground terminal screw. In professional applications the neutral terminal and ground terminal are connected together as one functional lead, preferably with a suitable conductive metal bar and spot welded to create permanent continuity between both terminals.

SUMMARY OF THE INVENTION

The self grounding electrical outlet of the present invention provides electrical ground to any outlet wiring whereby the existing wiring of the building only has two wires, a hot, and a neutral but does not have a green ground wire. Since all neutral wires are grounded to either a water pipe or a rod in the ground and/or both, the existing neutral pole is grounded already. Connecting the neutral and ground terminals permanently as one lead provides ground function for the ground prong on the three prong outlet should the existing wiring only have two wires and not a third ground wire. The present invention merely jumps the neutral to ground because the neutral is grounded already. Furthermore, the electrical supplier whether it be Edison, the city or even a private industry must ground the neutral supply before it gets to the consumer. Therefore it is reliable to say that the neutral line is already grounded twice before the use and manufacture of the present invention.

BRIEF DESCRIPTION OF THE DRAWINGS

FIG. 1 shows a perspective view of the present invention.

DETAILED DESCRIPTION OF THE INVENTION

The objects and advantages of the present invention are obtained by the full ground provided to the third prong, the ground prong on a three prong outlet, such provided by simply creating permanent continuity between the neutral and ground terminals on a three terminal outlet. Since the neutral pole is grounded twice, once by the power supplier and again by the electrical installer, the existing neutral pole is a perfect carrier for the third terminal, the ground.

The obvious advantages of the present invention is the convenience to the consumer whereby should the consumer have only two wires in the building and not a green ground wire, the present invention provides full ground to the outlet without the need to install a third wire, a green ground wire, to either satisfy the consumer request to provide ground, possibly for modern appliances, computers, etc., or a possible electrical code that may require that the building outlets must be grounded.

A further advantage of the present invention is the simplicity of installation. A two wire power supply to the outlet can be installed with the outlet of the present invention, as the same simple two wire outlet installation, thereby providing full ground to the ground terminal. The present invention eliminates needless wire usage and promotes safety for grounded applications.

All electrical supplies in the United States are grounded. The neutral wire an all power supplies are clamped to a water pipe and/or a nickel-cadmium 8 to 10 foot rod driven into the ground. The latest electrical code requires both.

If an individual were to inspect a modern electrical panel, it would be evident to see the white neutral wires ganged up and engaged on one terminal bar and all white wires fastened connectably with screws in which the wires are inserted into holes in the terminal bar. A much thicker white wire, the main neutral, is connected to the same terminal bar and routed to the nearest water pipe as well as a ground rod and the main ground wire is clamped to the water pipe as well as the ground rod.

The green ground wires from all the circuits are ganged up in the same manner as the neutral wires, depending on the design of the electrical circuit panel box. In some boxes the green wires are fastened into the neutral bar, in other box designs they have a separate green wire terminal bar. However, in all instances both the green wires and the neutral wires are mechanically engaged together either by connecting the two terminal bars together by a common wire, or by engaging the two by use of a clamp and then both regardless how it is done, are connectably fastened to a water pipe and a rod in the ground.

The present invention electrically duplicates the modern design of electrical panel wiring. The present invention connects the neutral and ground in the same manner that the panel terminates both ground and neutral together.

I claim:

1. A self-grounding electrical outlet comprising:

a three prong electrical outlet providing a 120 volt supply having one electrically positive insertable terminal, one electrically neutral insertable terminal and one grounded insertable terminal, said neutral and grounded terminals mechanically and permanently connected to form a continuous circuit, said circuit electrically and permanently connects the neutral and ground terminals functions as one function;

this connection is comprised of;

a single pole electrically continuous relay bar connectedly fastened by spot welding to the three prong electrical outlet neutral terminal and connectively fastened from neutral terminal to ground terminal by spot welding for the purpose of establishing permanent electrical continuity between the neutral and ground terminals;

wherein this permanent connection between the neutral and ground terminals provides electrical ground utilizing the neutral terminal as a conductor to ground the power source.

* * * * *